US010443227B1

(12) United States Patent
Workman

(10) Patent No.: US 10,443,227 B1
(45) Date of Patent: Oct. 15, 2019

(54) BUILDING SYSTEM

(71) Applicant: Tom Edward Workman, Dallas, TX (US)

(72) Inventor: Tom Edward Workman, Dallas, TX (US)

( * ) Notice: Subject to any disclaimer, the term of this patent is extended or adjusted under 35 U.S.C. 154(b) by 0 days.

(21) Appl. No.: 15/956,429

(22) Filed: Apr. 18, 2018

(51) Int. Cl.

| | |
|---|---|
| ***E04B 2/00*** | (2006.01) |
| ***E04B 1/04*** | (2006.01) |
| ***E04B 1/21*** | (2006.01) |
| ***E04C 2/38*** | (2006.01) |
| ***E04B 1/343*** | (2006.01) |
| ***E04B 1/348*** | (2006.01) |
| ***E04C 2/04*** | (2006.01) |

(52) U.S. Cl.
CPC ..... *E04B 1/043* (2013.01); *E04B 1/21* (2013.01); *E04B 1/34321* (2013.01); *E04B 1/34807* (2013.01); *E04C 2/04* (2013.01); *E04C 2/382* (2013.01)

(58) Field of Classification Search
CPC ..... E04B 1/043; E04B 1/21; E04B 1/34321; E04B 1/34807; E04B 1/39; E04B 2/30; E04C 2/04; E04C 2/382; E04C 5/16; E04G 17/12
USPC ..... 52/220.8
See application file for complete search history.

(56) References Cited

U.S. PATENT DOCUMENTS

| | | | | |
|---|---|---|---|---|
| 3,722,849 | A * | 3/1973 | Luyben | E04G 13/00 249/219.1 |
| 4,538,391 | A * | 9/1985 | Skrabis | E04B 1/762 52/478 |
| 9,234,349 | B1 * | 1/2016 | Daiber | E04C 2/06 |
| 2009/0260306 | A1 * | 10/2009 | Ebanks | E02D 27/02 52/285.3 |
| 2010/0064615 | A1 * | 3/2010 | Boese | E04G 13/00 52/426 |
| 2018/0010337 | A1 * | 1/2018 | Giarritta | B29D 99/0021 |

* cited by examiner

*Primary Examiner* — Beth A Stephan
(74) *Attorney, Agent, or Firm* — Jeffrey Roddy

(57) ABSTRACT

A system for the construction of modular structures includes sheet metal panels that include at least some pre-cut portions configured to be deformed in such as way as to provide a gripping and reinforcing function for a cementitious material when poured around the structure constructed of the sheet metal panels. Window and door openings are typically precut prior to shipping to a construction site and then punched out of a sheet metal panel at a construction site. The invention provides for an extremely compact method of shipping load bearing components to the construction site and reduced labor time in assembling a building framework.

5 Claims, 11 Drawing Sheets

FIG. 5D
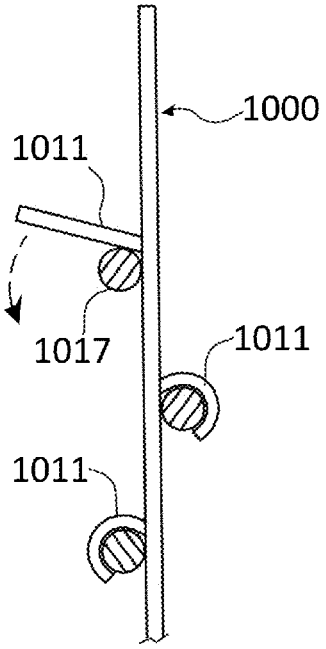
FIG. 5E
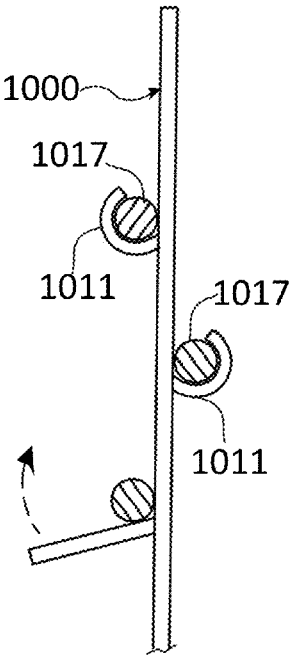
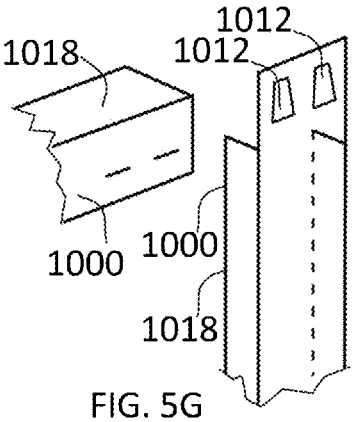
FIG. 5G
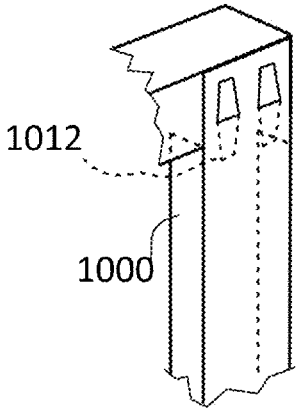
FIG. 5H
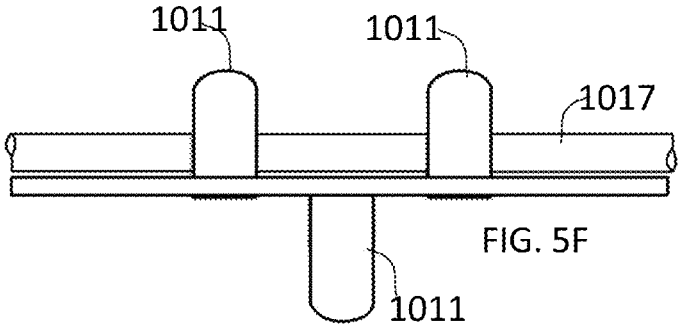
FIG. 5F 1023
1026
1026
1018
1018
1018
1000
1000
1018
1020
1020

1018
1023
1018
1026
1018
1018
1000

1018
1023
1018
1026
1018
1018
1000

1026
1020
1026
1026
1026
1023

1036
1011
1022
1011
1022
1011
1036
1023

1036
1036

BUILDING SYSTEM

FIELD OF THE INVENTION

This invention relates generally to the technical field of modular buildings.

BACKGROUND OF THE INVENTION

Modular buildings are an increasingly popular method of providing affordable construction. Foamed concrete also called foamcrete, is a relatively recent development that offers high insulative properties and may be substituted for other structural materials such as wood or metal studs for forming vertical walls and domes. Typically, foamcrete is sprayed or pumped between removable forms and allowed to set. Small homes made almost entirely of foamed concrete are known in the art. Despite the ease of foamcrete application, necessary reinforcing of the foamcrete takes much more time than the actual spraying or pumping of the foamcrete. It would be desirable to provide an apparatus and method for the construction of a embedded reinforcing structure that augments the load bearing properties of the foamcrete and provides a gripping surface for the set foamcrete outer shell.

SUMMARY OF THE INVENTION

Various implementations according to the present invention include a system of building components that are partially formed prior to delivery to a building site and then finally formed at the building site for assembly into a framework that is disposed between cementious material and forms both a load bearing structure and reinforcing lattice for the cementious material which may be a foamed concrete.

In a general example implementation according to the present invention, 16GA sheet metal panels are laser cut or stamped such that portions of the sheet metal outlined by a laser cut are adapted to be bendable away from either side of the sheet, and form openings for the passing through of cementious material for the reinforcing thereof.

In an aspect combinable with the general implementation, the laser cut sheet panels are shipped flat to a building site prior to bending.

In an aspect combinable with the general implementation, the laser cut sheet panels are pressed and/or bent at the building site such that the portions of the sheet metal outlined by the laser cutting may form "tabs" or "finger-like" projections on either side of the sheet.

In an aspect combinable with any other aspect, the sheet panels may be formed on-site with a sheet metal brake to form straight-line bends such as 90° angles at a border of the sheet.

In an aspect combinable with any other aspect, the sheet panels may be formed with one or more dies configured to press the sheet panel from a topside an underside or an edge.

In an aspect combinable with any other aspect, the sheet panel may be formed on-site with one or more rollers configured to press the sheet panel from a topside, an underside or an edge.

In an aspect combinable with any other aspect, the sheet panel may be formed to include 90° flanges at a border of the sheet panel so that multiple sheet panels may be adjacently connected at the flanges.

In an aspect combinable with any other aspect, the sheet metal panels may be roll formed to produce curving channels.

In an aspect combinable with any other aspect, the sheet metal panels may include laser cut patterns that are configured to be punched out at the building site to produce apertures in the sheet metal panels.

In an aspect combinable with any other aspect, the sheet metal panels may include laser cut patterns that are configured to be punched out at the building site to produce apertures in the sheet metal panels wherein the apertures may allow the passing through of conduit, rebar, piping and other objects.

In an aspect combinable with any other aspect, the laser cut sheet metal may be further formed in continuous process on site using a specially equipped trailer that includes forming rollers, sheet metal brakes and forming dies or punches.

In an aspect combinable with any other aspect, the sheet metal panels are configured to form a load bearing upright assembly.

In an aspect combinable with any other aspect, the sheet metal panels may be partially stamped or otherwise formed into a subassembly that may be separated by shearing into separate load bearing sheet metal studs having a 'C' shaped profile.

In an aspect combinable with any other aspect, pouring forms may be placed on either side of a load bearing upright assembly comprised of joined sheet metal panels.

In an aspect combinable with any other aspect, joined sheet metal panels may form a ceiling or a roof structure.

In an aspect combinable with any other aspect, cementious material may be poured around an upright assembly of connected sheet metal panels.

In an aspect combinable with any other aspect, openings in the sheet metal panel form channels for the passageway of cementious material.

In an aspect combinable with any other aspect, pouring forms may be placed on either side of a roof structure constructed of the sheet metal panels.

In an aspect combinable with any other aspect, cementitious material may be poured between the pouring forms and the sheet metal panels forming a roof.

BRIEF DESCRIPTION OF THE DRAWINGS

FIGS. 5D, 5E and 5F depict respectively, a side view of an exemplary cut pattern 75 wherein projecting portions are configured to fold down over rebar, a side view of an exemplary cut pattern wherein projecting portions are configured to fold up over rebar, and a top view thereof;

FIGS. 5G and 5H depict projecting portions employed to join two adjacent sheet metal sections;

REFERENCE LISTING OF THE NUMBERED ELEMENTS

Figure 1:
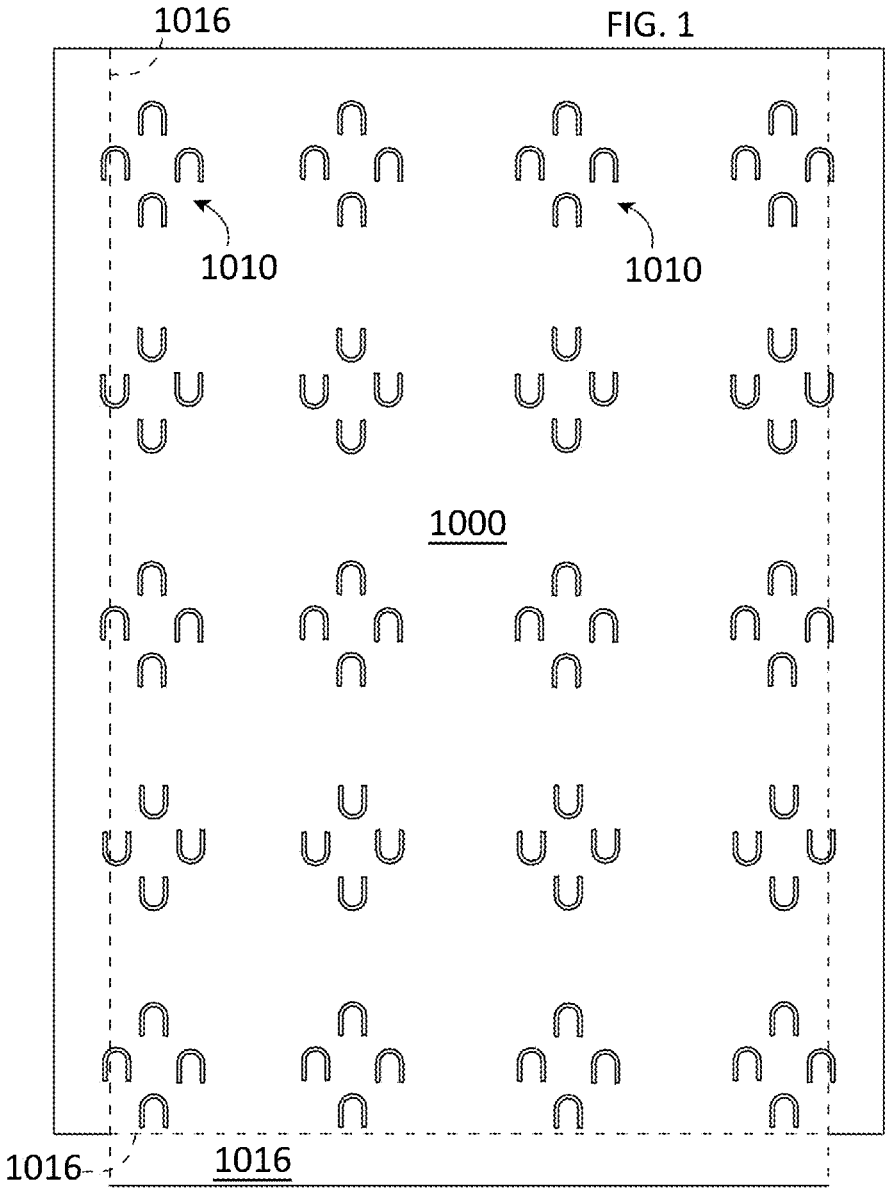
FIG. 1 depicts an exemplary sheet metal panel in an implementation according to the present invention.

1000 sheet metal panel
1010 laser cut pattern
1011 projecting portion
1012 tab
1014 channel
1015 conduit
1016 bend
1017 rebar
1018 flange
1019 aperture
1020 fastener
1022 overlap
1023 panel assembly
1024 foundation
1026 join
1028 vertical conduit channel
1030 horizontal conduit channel
1036 forms
1040 cementitious material
1042 fastener
1046 foundation
1048 ducting
1049 access cover assembly
1050 wall

DEFINITIONS

The term "poured" is intended to encompass "pumped" cementitious material. The term "cementitious" means any cement like material with a water fraction that typically undergoes chemical transformation from a fluid to a solid state. The term "sheet metal" may mean any practicable thickness of sheet metal of any suitable composition. The term "flat-packed" means packed in a compact unassembled state. The term "foundation" means any foundation for a building structure, e.g., slab, pier and beam, etc. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of the particular implementations described in this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting. One or more features, objects and aspects of any implementation described herein may be combined with one or more features, objects and aspects of any other implementation described herein.

DETAILED DESCRIPTION OF THE EMBODIMENTS

Referring to FIGS. 1-11, a building system includes a plurality of otherwise planar sheet metal panels wherein some of the panels include pre-cut portions that are configured to bend away from either side of the panels. Once bent, the pre-cut portions project at various angles away from the faces of the panels and form openings and projections around which a cementitious mixture may flow so that the cementitious material when dry, will adhere to the sheet metal panels.

Typically, the sheet metal panels 1000 are shipped stacked in a nested condition to a building site and further transformed at the site dies, rollers and/or hand tools. Flanges 1018 are formed in the panels for flange-to-flange joining 1026 between adjacent panels 1000. Once a foundation 1046 is laid, walls 1050 may be constructed of the sheet metal panel assemblies 1023 and pouring forms 1036 affixed temporarily to the flanges 1018 of the panels. When the pouring forms are in place, a cementitious material 1040 may be poured between the panels and the pouring forms. Doorways, window openings and other apertures require a pouring form insert so that the cementitious material may flow around the aperture 1019. When the cemenititious material is set, the pouring forms are removed. Window frames and doors may be inset into the corresponding apertures. The flange-to-flange connections 1026 may include overlapping flanges 1022 and threaded fasteners 1020 or glue. Vertical or horizontal channels (1028, 1030) between the panels may be formed in the cementitious layer at the time of pouring by the insertion of a formed sheet metal or plastic channel that may be subdivided into multiple sections such that water pipes, HVAC ducting 1048 and electrical conduit may segregated according to various building codes. In one implementation, electrical conduit and plumbing is run along one or more interior walls and is covered by an access cover assembly 1049. It should be understood that the foregoing methods may be used to form the foundation as well as the exterior and interior walls of a structure. Interior load bearing forms for arches, columns and other architectural elements may be formed using the foregoing methods.

FIG. 1 is a side elevation of an exemplary panel 1000 with a repeating cut patterns 1010 of bendable shapes that form projections 1011 when bent away from the panel, and wherein the projections may include a bendable distal portion that is configured to bend in a direction away from the proximal portion nearest the panel. When cementitious material hardens around the projections, the set material is gripped and will not chip or fall away from the panel. Dashed lines showing are exemplary bend lines 1016 to create a base flange 1018 and side flanges 1018. Flanges may be bent to abut and fasten, or to overlap with the adjacent flanges of another panel.

Figure 2:
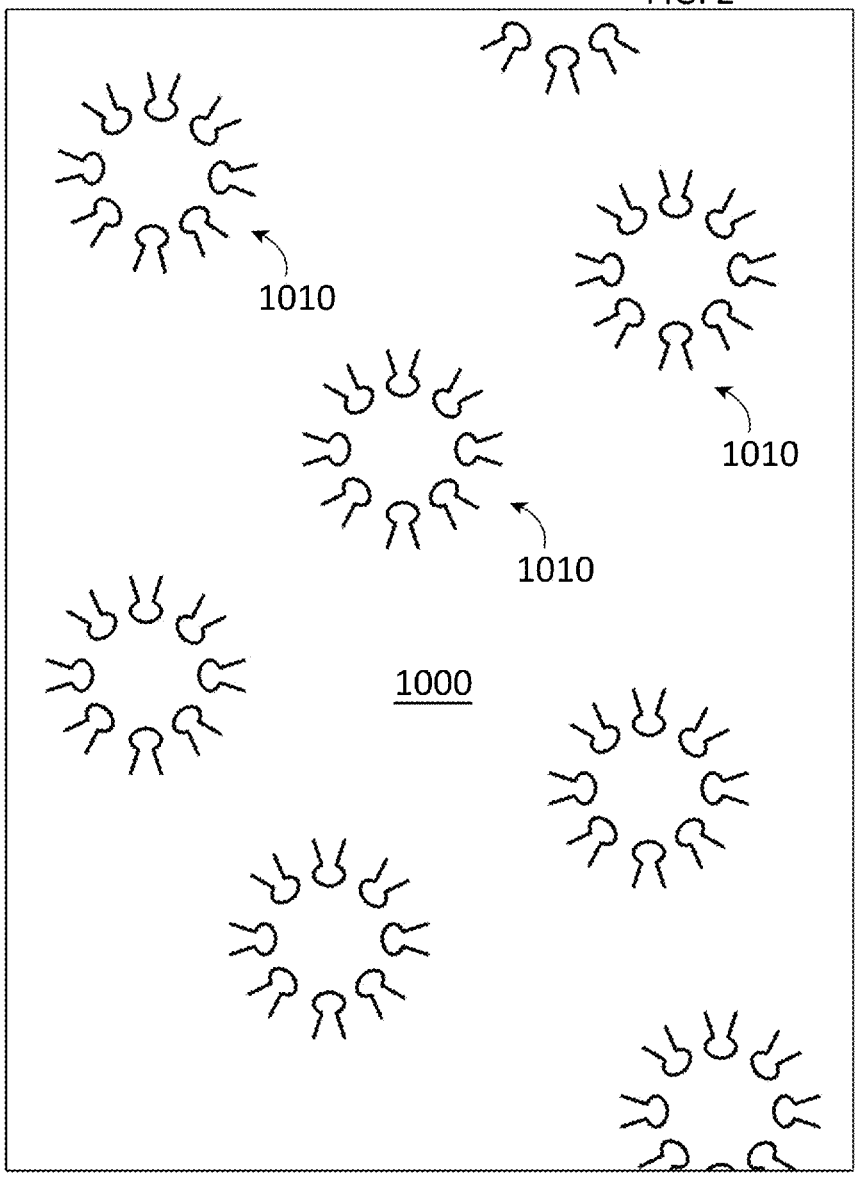
FIG. 2 is another exemplary sheet metal panel in an implementation according to the present invention.

FIG. 2 is another side elevation showing an exemplary panel 1000 with a randomized cut pattern 1010. In the particular implementation shown, the projecting portions may be initially bent where each one meets the panel body, and at the distal (bulbous) end of each projection.

Figure 3:
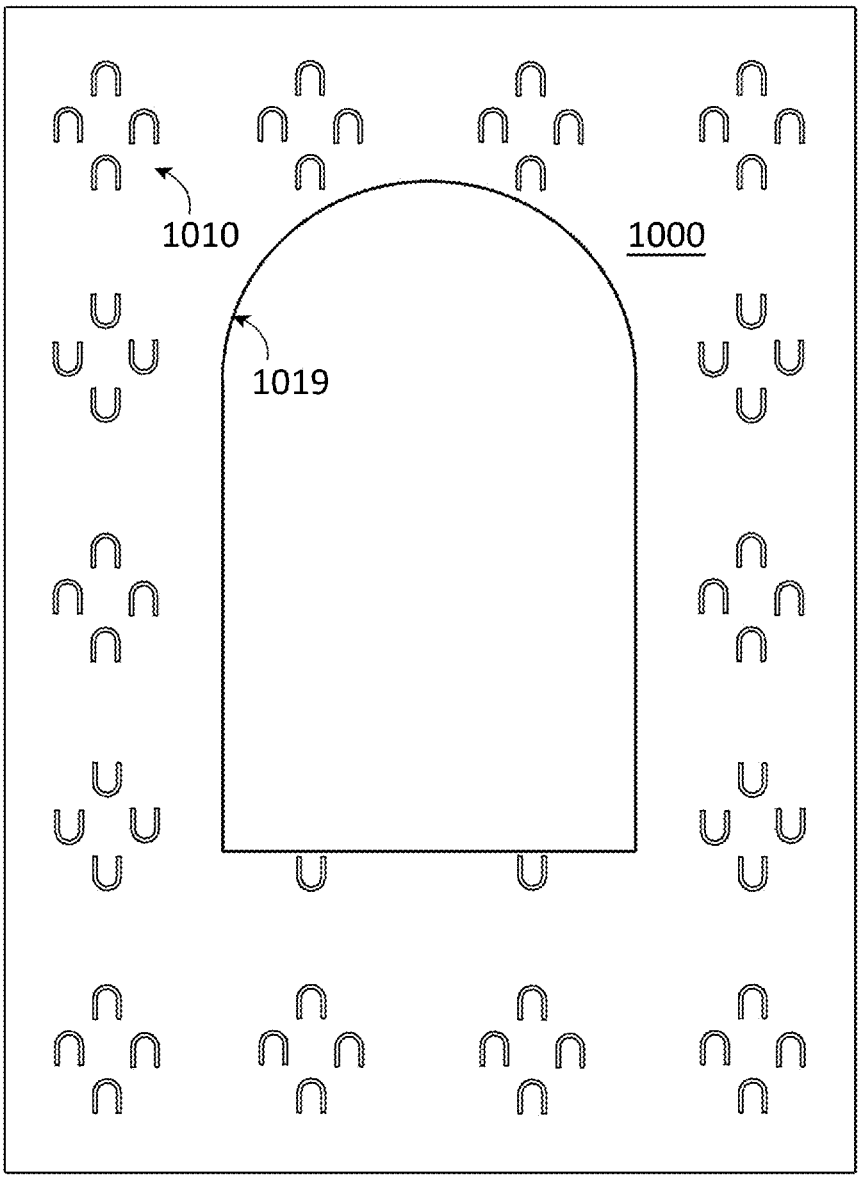
FIG. 3 is another exemplary sheet metal panel with a void for a window.

FIG. 3 is another side elevation showing an exemplary panel 1000 that includes a precut aperture 1019 for a window. Typically, a temporary pouring form 1036 constructed of wood or another suitable material would posses a shape corresponding to the pre-cut aperture. When the panel assemblies 1023 are faced with the pouring forms 1036, the window shape of the pouring form would be inserted into the pre-cut aperture and abut the inside surface of the opposite pouring form. When the cementitious material is poured typically by pumping into the cavity formed between the panel assemblies 1023 and the pouring forms, it will flow around the projecting portions 1010 and the window (or door) shape of the pouring forms.

Figure 4A:
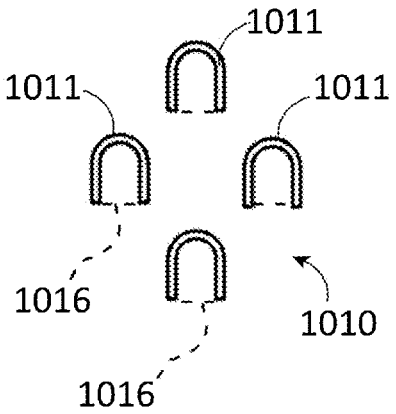
FIGS. 4A, 4B and 4C are exemplary cut patterns suitable for use in various implementations according to the present invention.
Figure 4C:
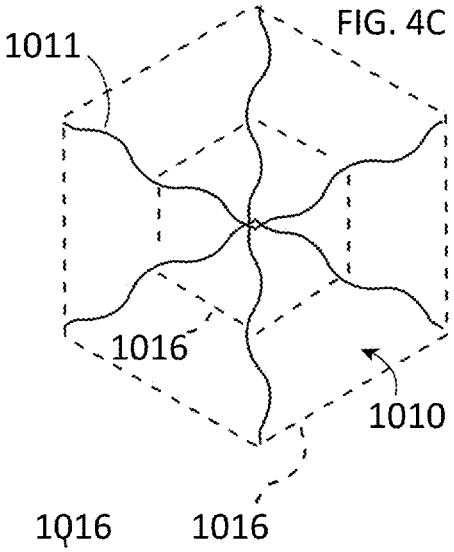
Figure 4B:
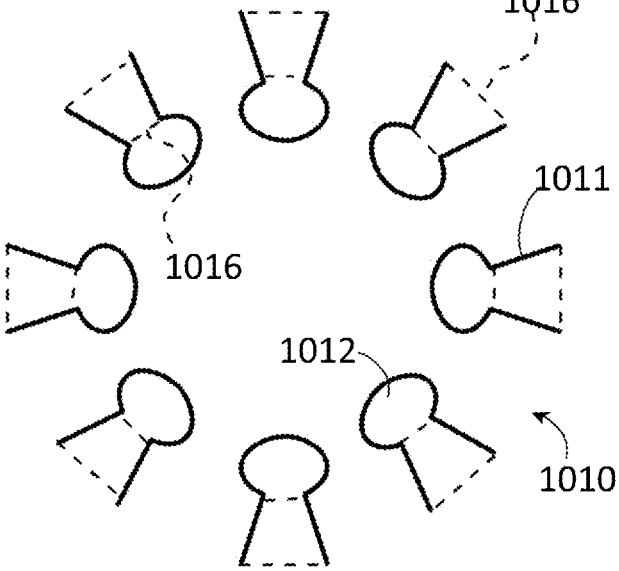

FIGS. 4A-4C show various implementations of a cut pattern in a sheet metal panel. The number and position of the pattern groupings disposed on a panel may vary as well as the number of projecting portions in each pattern grouping. Pattern groupings may include spaces between the projecting portions, or, the cuts forming the projecting portions my connect. The projecting portions shown in (FIGS. 4B, 4C) include a bend where the portion is joined to the panel, and a bend at the distal end of the projecting portion. Projecting portions may be configured so that when bent away from a panel, the projecting portions include an aperture for cementitious material to flow through and around.

Figure 5A:
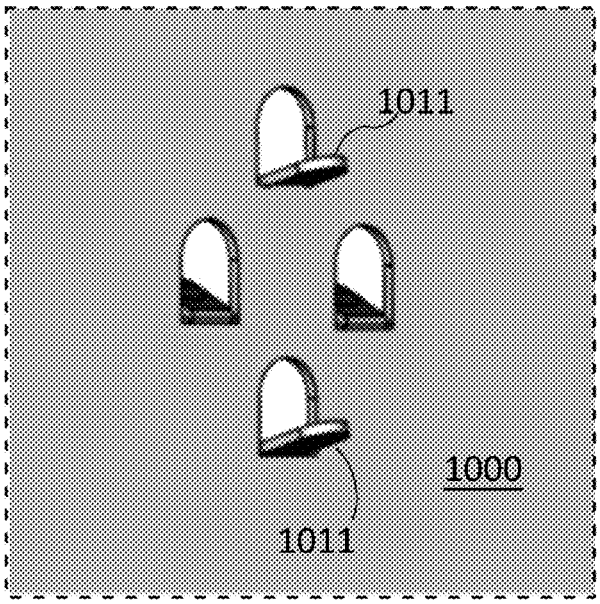
FIGS. 5A, 5B and 5C depict respectively, a perspective view of an exemplary cut pattern configured to be bendable to form projecting portions, a side view thereof and a top view thereof.
Figure 5B:
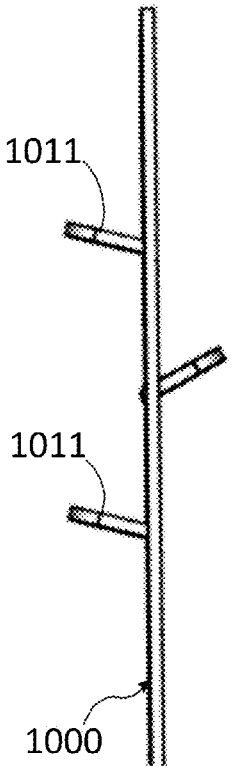
Figure 5C:
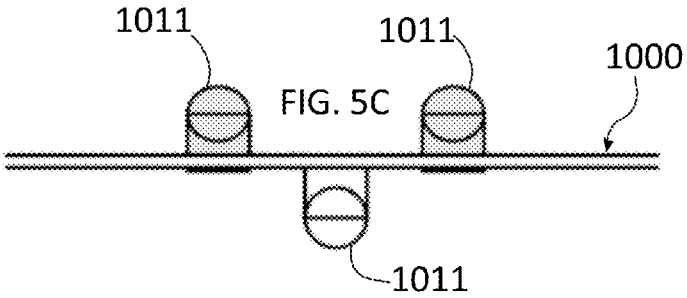

FIGS. 5A, 5B and 5C depict respectively, a perspective view of an exemplary cut pattern configured to be bendable to form projecting portions 1011, a side view thereof and a top view thereof.

FIGS. 5D, 5E and 5F depict respectively, a side view of an exemplary cut pattern 190 wherein projecting portions 1011 are configured to fold down over rebar 1017, a side view of an exemplary cut pattern wherein projecting portions are configured to fold up over rebar, and a top view thereof. Cut patterns configured to support rebar from the top and bottom may be mixed within a single panel, or, the panel may be inverted during construction to achieve a preferred support method. The bendable tabs of the projecting portions by also be configured to provide fastening to an adjacent panel or a flange of a panel.

Figures 6A, 6B, 6C, 6D, 6E:
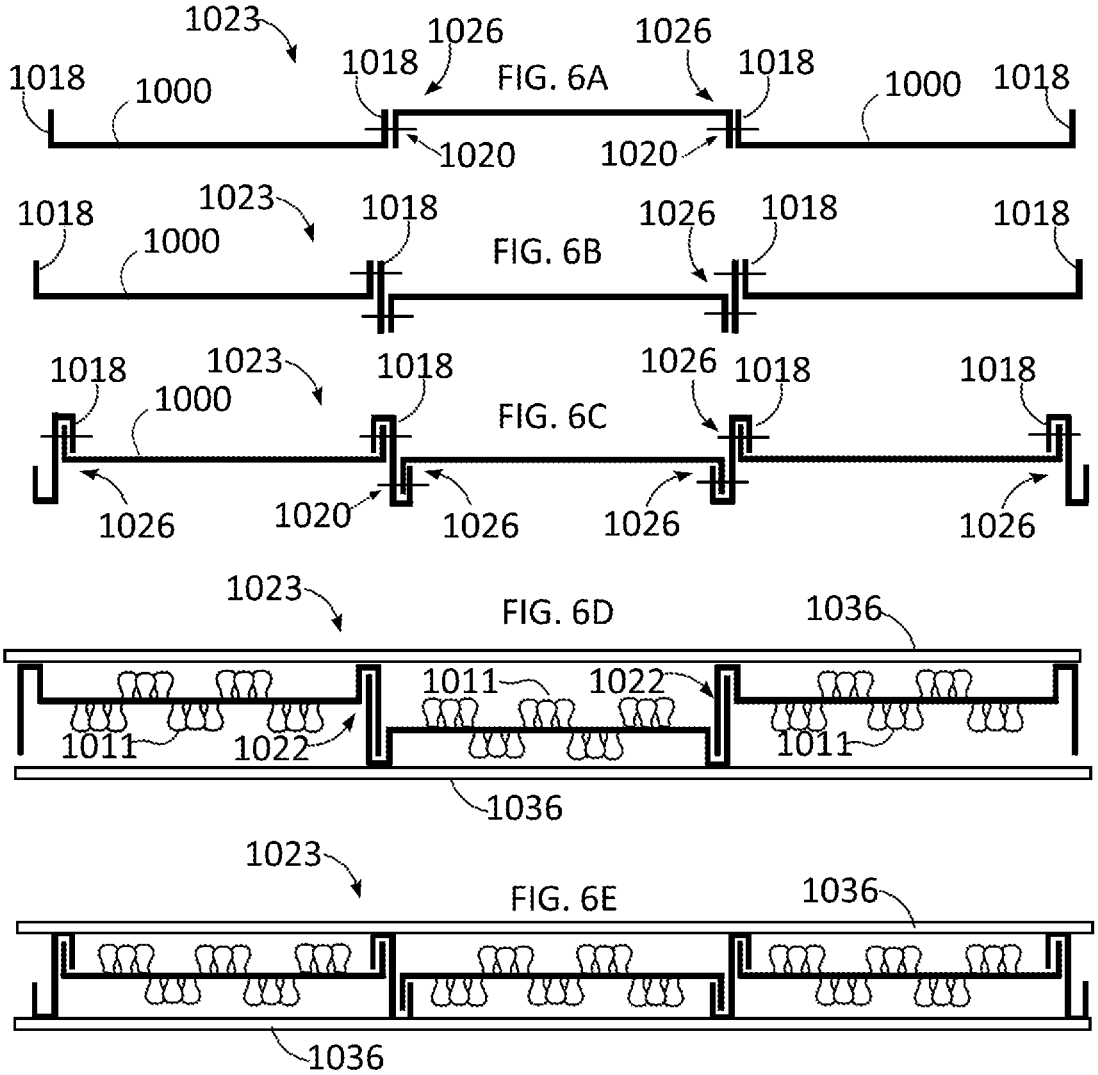
FIGS. 6A, 6B, 6C, 6D, 6E, 6F, 6G and 6H depict various flange-to-flange connecting configurations, with FIG. 6H being an end section of a column prior to pouring cementitious material with curved joined sheet metal forms and pouring forms affixed around the column.

FIG. 6A is a top edge view of a panel assembly 1023 wherein the flanges are configured to abut one another and be connected by sheet metal fasteners of any suitable type. The configuration shown in (FIG. 6A) differs from that shown in (FIGS. 6B-6G) in that the configuration allows for only a single layer of adjacently disposed cementitious panels.

FIG. 6B is a top edge view of a panel assembly 1023 wherein the flanges are configured to connect to one another via an intermediary flat plate.

FIG. 6B is a top edge view of a panel assembly 1023 wherein the flanges are configured to connect to one another via an intermediary member that is bent to form a connecting bracket. Typically such connecting brackets may be made of the same material as the panels, or in some cases may be extruded plastics or a composite. In any case, the brackets may be slid from the top edge of the panel assembly 1023 and fixed in place by sheet metal screws or glue.

FIG. 6D shows an implementation wherein flanges of adjacently disposed panels are interconnected. During construction, the interconnecting flanges may support the structure temporarily while fastening members are applied the horizontal or vertical flanges. Prior to application of the pouring forms 1036 which are typically fastened to the panel flanges, the projecting portions 1011 of the cut patterns are bent away from the surface of the panels—typically to both sides of the panel to form gripping surfaces for set cementious material.

Figure 6F:
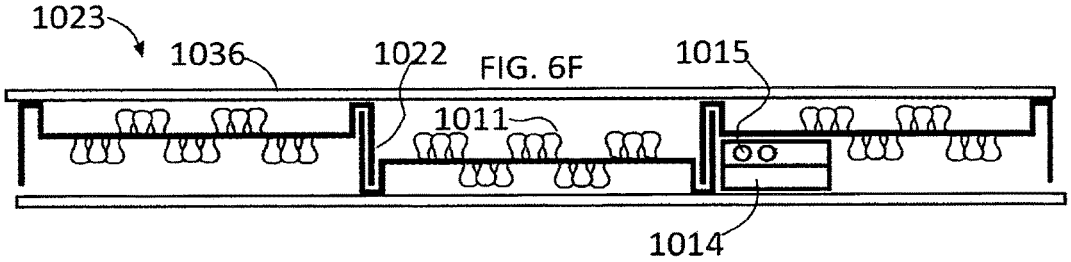
Figure 6G:
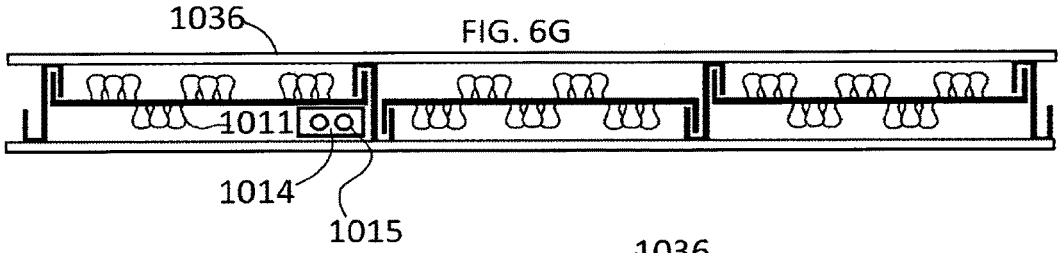

FIGS. 6F and 6G show the placement of vertically disposed tubes, conduits or channels 1014, which is typically a sheet metal construction or a plastic tube or extruded rectangular channel that is sized and shaped to enclose water pipe, electrical conduit or HVAC ducting. Channel 1014 may include a smooth interior surface and be subdivided into one or more smaller channels in order to segregate and guide various elements placed therein.

Figure 6H:
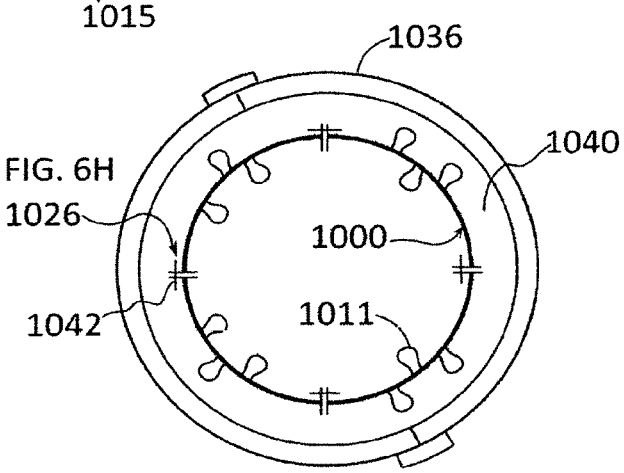

FIG. 6H shows in implementation according to the present invention employed in the construction of a pier or column.

Figure 7:
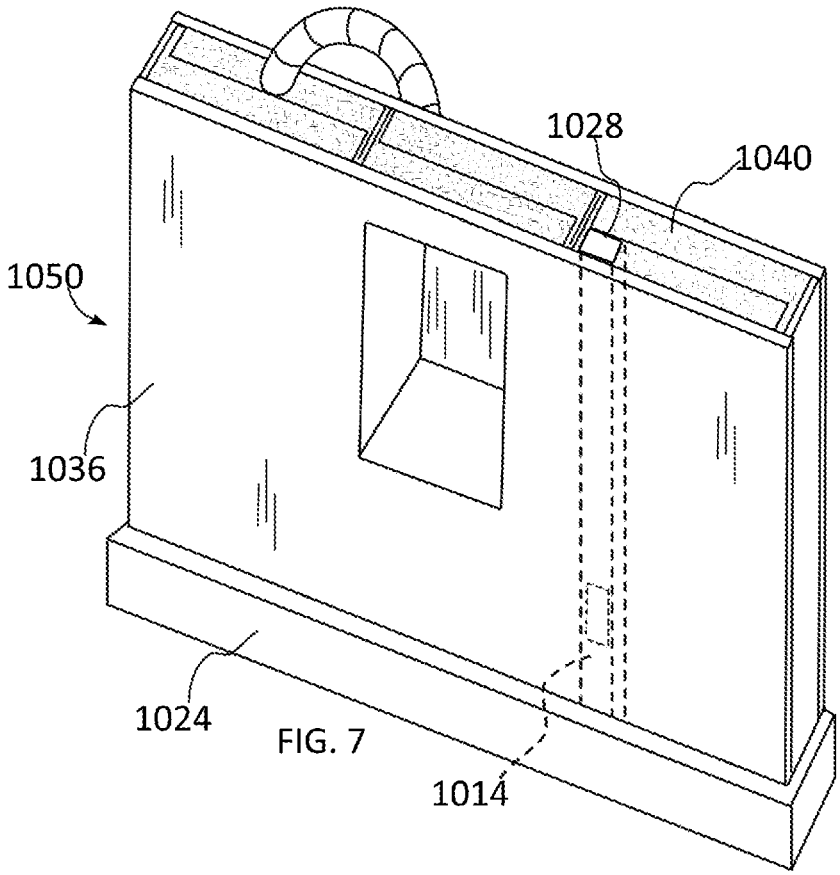
FIG. 7 shows joined sheet metal panels with a pouring form affixed to either side.

FIG. 7 is an orthographic projection of a section of panel assembly immediately after the spaces between the panels and the pouring forms have been filled with cementitious material. The dashed lines indicate an exemplary placement of a channel 1014 that is configured to admit pipe or electrical conduit.

Figure 8:
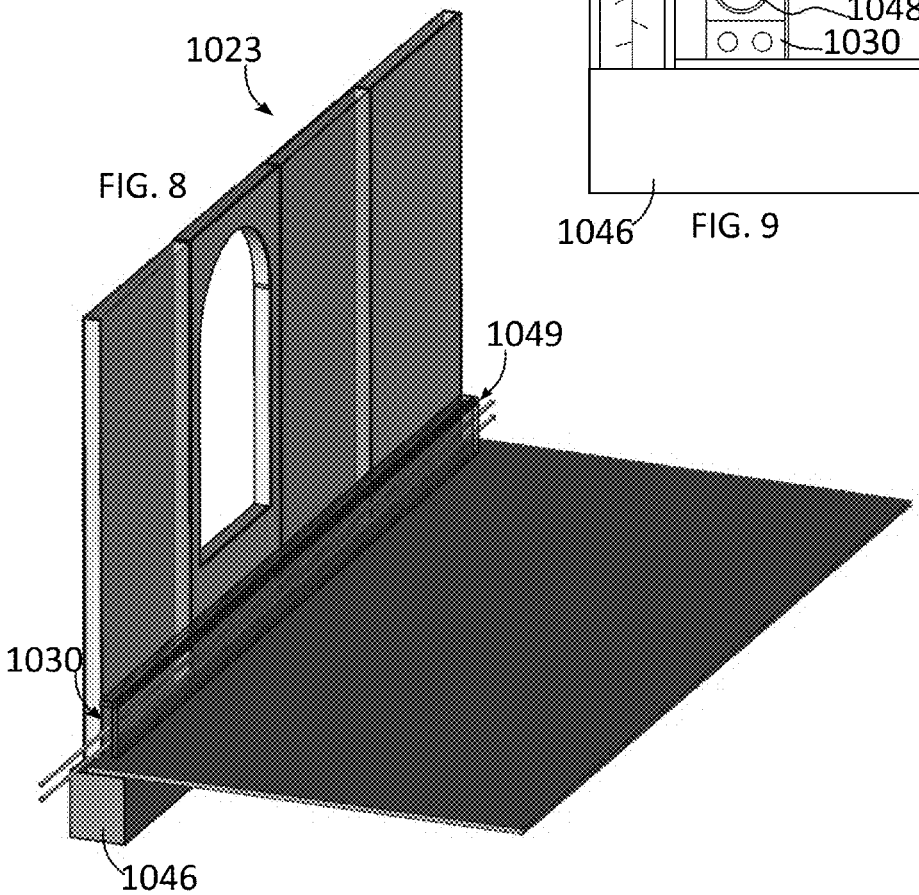
FIG. 8 is an isometric view of a section of a completed poured wall, foundation and floor.

FIG. 8 is an isometric view of a section of a completed poured wall (see FIG. 6A), foundation and floor. Also shown is an access cover assembly 1049 that is configured to separate infrastructure (electrical, water and ducting) from the living space while also providing easy access for the maintenance thereof.

Figure 9:
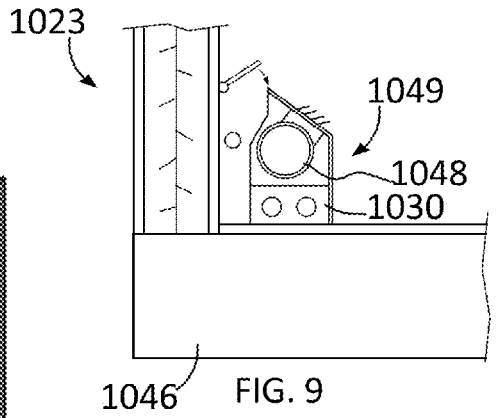
FIG. 9 is a partial end view of an access cover assembly that is configured to cover HVAC ducting, water lines and electrical conduit.

FIG. 9 is a partial end view of an access cover assembly 1049 that is configured to cover HVAC ducting 1048, water lines and electrical conduit. The access cover assembly 1049 may include one or more horizontal conduit channels 1030 by which the various wires pipes and ducts are segregated.

Figure 10:
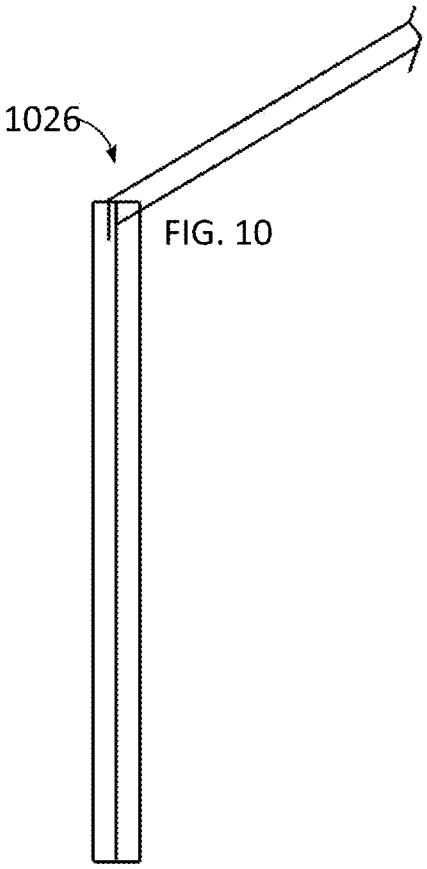
FIG. 10 is a side elevation of a join between a vertical panel wall section and a roof section.
Figure 11:
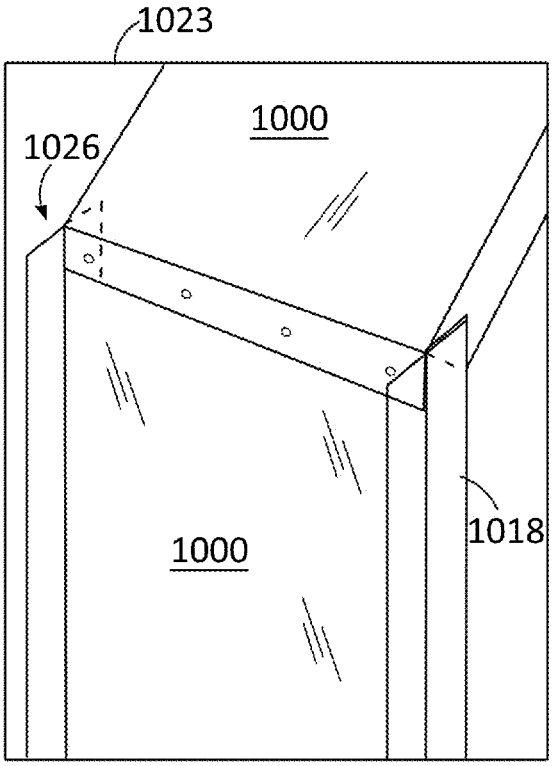
FIG. 11 shows an exemplary connection between adjacent panels (vertical assembly and roof assembly) with flanges.

FIGS. 10 and 11 are respectively, side elevation and isometric views of a vertical panel assembly 1023 joined to a canted roof structure of the same panels wherein the bottom panels of the roof structure have been formed in such a way to affix to the upper portions of the vertical panels. Any angular deviation is possible by the angle of the flange. Similar to the pouring forms used with the vertical panel assemblies, pouring forms (e.g., plywood facings) are supported from the inside of the structure (e.g., by pillars and joists). Plywood facings are also applied to the outwardly facing flanges of the roof panels. Cementitious material is pumped, shoveled or poured through apertures in the plywood to fill the spaces between the panels and the pouring forms.

While the invention has been described by the embodiments shown herein, it is not intended to limit the scope of the invention to the particular form set forth. For example, it is conceivable that in some cases and with the development of new materials, composite materials, carbon fiber resins and plastics, etc., may be substituted for the sheet metal panels of the particular embodiments. On the contrary, the invention is intended to cover such alternatives, modifications, and equivalents as may be included within the spirit and scope of the invention as defined by the appended claims.

What is claimed is:

1. A building method comprising the steps of:

providing a plurality of panels wherein at least some of the panels include cut patterns that are configured to be bendable, and wherein at least some of the panels are shipped in a flat stacking configuration;

receiving the plurality of panels at a building site;

bending the cut patterns to form projecting members that project away from either a front or back face of the panels;

bending the panels to form flanges;

assembling the plurality of panels into an upright structure wherein at least some of the panels are positioned adjacent one another and connected flange-to-flange.

2. The method according to claim 1 further comprising the step of temporarily sheathing the upright structure with pouring forms wherein a gap is formed between surfaces of the pouring forms and the front and back faces of the panels.

3. The method according to claim 2 further comprising the step of pouring a cementitious material between the pouring forms and the panels and allowing the cementitious material to dry.

4. The method according to claim 3 further comprising the step of removing the pouring forms from the upright structure.

5. The method according to claim 1 further comprising the step of stamping or cutting apertures for window and door openings into at least some of the plurality of panels.

* * * * *